US007373907B2

(12) United States Patent
Balaraman et al.

(10) Patent No.: US 7,373,907 B2
(45) Date of Patent: May 20, 2008

(54) VALVE LIFTER GUIDE

(75) Inventors: Sriram Balaraman, Wood Dale, IL (US); Susan L. Lukasik, Lombard, IL (US); Kenneth R. Seymour, II, Plymouth, WI (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 204 days.

(21) Appl. No.: 11/425,314

(22) Filed: Jun. 20, 2006

(65) Prior Publication Data

US 2006/0272601 A1 Dec. 7, 2006

Related U.S. Application Data

(63) Continuation-in-part of application No. 11/047,012, filed on Jan. 31, 2005, now Pat. No. 7,137,373.

(51) Int. Cl.
*F01L 1/14* (2006.01)

(52) U.S. Cl. ..... 123/90.5; 123/90.16; 123/90.48

(58) Field of Classification Search ..... 123/90.5, 123/90.16, 90.15, 90.48
See application file for complete search history.

(56) References Cited

U.S. PATENT DOCUMENTS

| | | | | |
|---|---|---|---|---|
| 5,088,455 | A | 2/1992 | Moretz | |
| 5,546,899 | A | 8/1996 | Sperling et al. | |
| 6,143,993 | A | 11/2000 | Andersson | |
| 6,405,699 | B1 | 6/2002 | Church | |
| 6,745,737 | B2 | 6/2004 | Evans et al. | |
| 6,782,858 | B2 * | 8/2004 | Haas et al. | 123/90.5 |

* cited by examiner

*Primary Examiner*—Zelalem Eshete
(74) *Attorney, Agent, or Firm*—Jeffrey P. Calfa; Gerald W. Askew

(57) ABSTRACT

A valve lifter guide (100, 900, 1100) includes at least one conduit (101, 901, 1101). The conduit (101, 901, 1101) has a first inwardly-curved surface (103) opposed to a second inwardly-curved surface (105) such that the conduit is capable of holding a valve lifter (200) between the first inwardly-curved surface (103) and the second inwardly-curved surface (105). The valve lifter guide (100, 900, 1100) may optionally include inwardly-curved alignment surfaces 1103.

20 Claims, 5 Drawing Sheets

FIG. 1
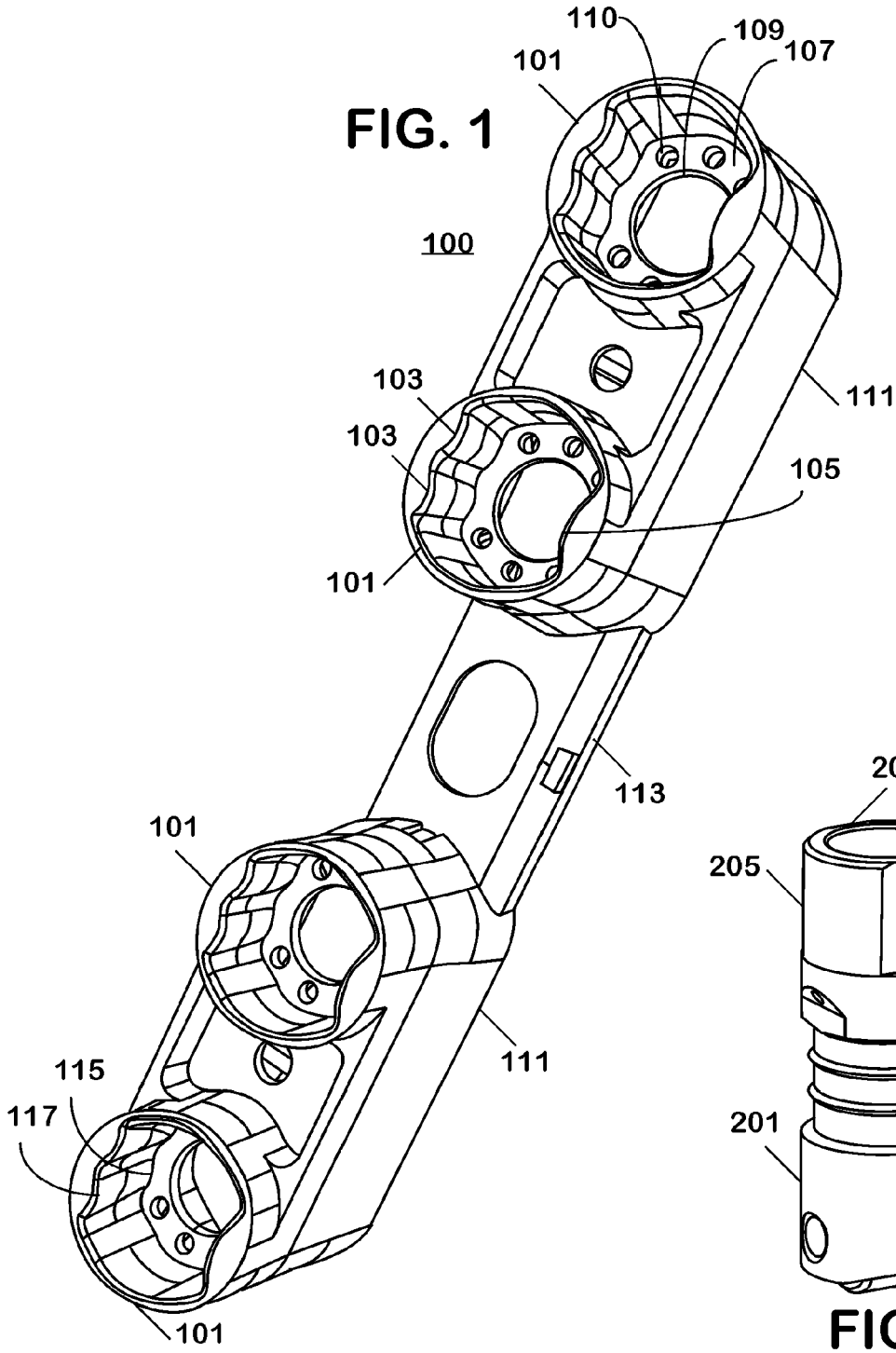
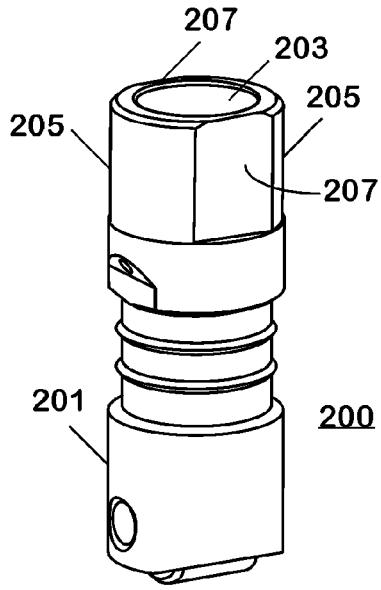
FIG. 2

FIG. 3
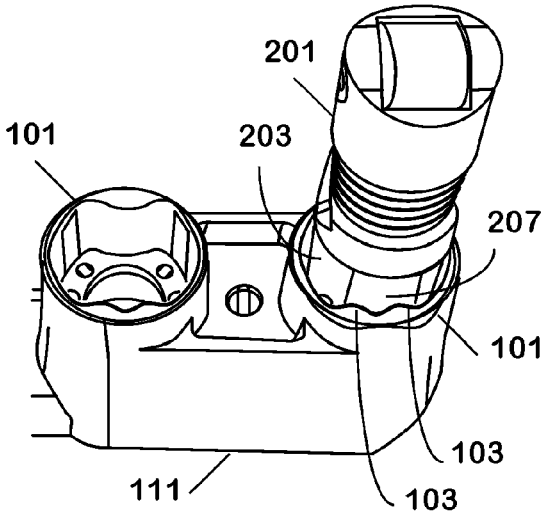
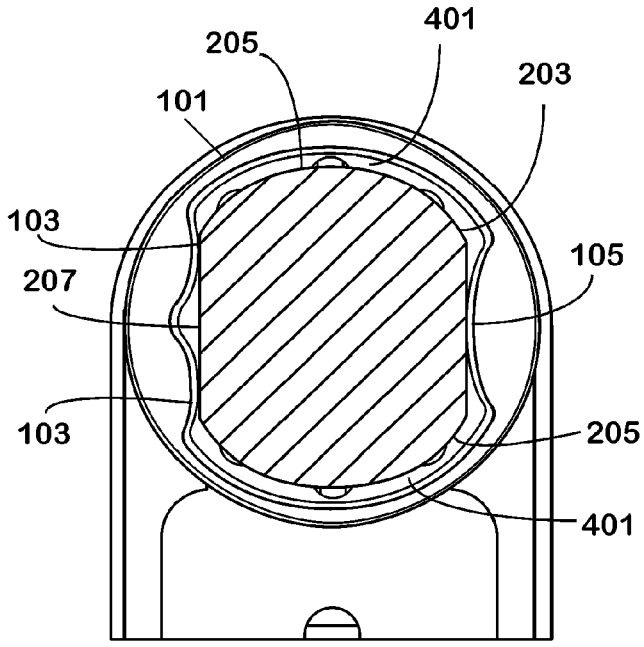
FIG. 4
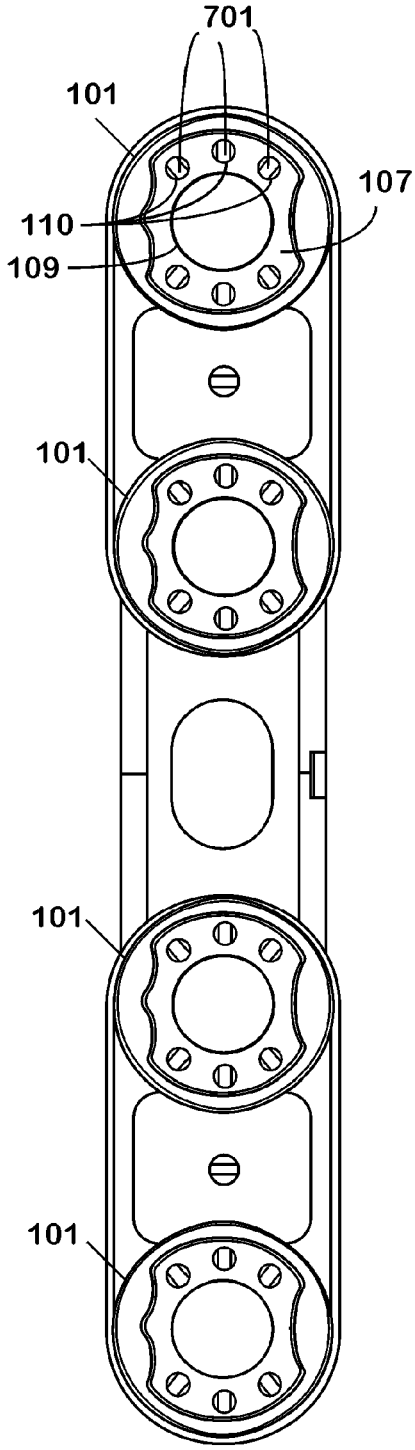
FIG. 7

VALVE LIFTER GUIDE

CLAIM OF PRIORITY

This application is a continuation-in-part application of and claims the priority benefit of the filing date of Non-Provisional application Ser. No. 11/047,012 filed Jan. 31, 2005, now U.S. Pat. No. 7,137,373 on behalf of the same inventors as the present application and assigned to the assignee hereof.

FIELD OF THE INVENTION

This invention relates to internal combustion engines, including but not limited to guides for valve lifters for internal combustion engines.

BACKGROUND OF THE INVENTION

Internal combustion engines are known to utilize valve lifters, also known as roller tappets, that have a roller that engages a camshaft lobe and an interface that engages a push rod at the other end. The rollers reduce friction to extend their life. The rollers need to maintain a particular orientation with respect to the camshaft to prevent damage to the rollers and/or the engine itself. For example, the roller may rotate about an axis parallel to the axis of rotation of the camshaft.

Metal guides are known to maintain the rollers in a specific orientation. Metal guides are often time-consuming and complicated to install, expensive to manufacture, and generate unwanted engine noise, in addition to suffering from wear due to metal-on-metal contact.

Accordingly, there is a need for a valve lifter guide that is inexpensive, easy to install, and does not generate unwanted engine noise.

SUMMARY OF THE INVENTION

A guide includes a base and at least one conduit extending from the base. The conduit has a first inwardly-curved surface opposed to a second inwardly-curved surface such that the conduit is capable of holding a valve lifter between the first inwardly-curved surface and the second inwardly-curved surface.

BRIEF DESCRIPTION OF THE DRAWINGS

FIG. 1 is a perspective view of a valve lifter guide in accordance with the invention.

FIG. 2 is a valve lifter that engages the valve lifter guide in accordance with the invention.

FIG. 3 is a perspective view of a valve lifter engaging the valve lifter guide in accordance with the invention.

FIGS. 4 and 5 are top views of the valve lifter guide engaging a valve lifter in accordance with the invention.

FIG. 7 is a top view of the valve lifter guide in accordance with the invention.

DESCRIPTION OF A PREFERRED EMBODIMENT

Figure 5:
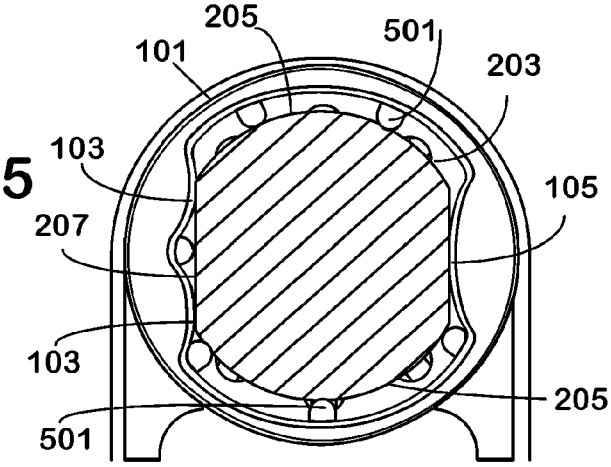

The following describes an apparatus for and method of reliably holding a valve lifter during assembly while preventing rotation of the valve lifter during normal engine operation. A valve guide includes a number of curved surfaces arranged along the inner surface of a conduit such that the curved surfaces engage the valve lifters during assembly so as to prevent them from falling out and also to provide an orientation of the valve lifter that prevents its rotation during normal engine operation.

A perspective view of a valve lifter guide is shown in FIG. 1. The valve lifter guide 100 includes a plurality of conduits 101 that have an outer surface that is substantially curved and an inner surface that is advantageously curved throughout the entire inner surface of the conduit 100. As shown in FIG. 1, this inner surface includes a number of inwardly-curved surfaces, including a pair of curved surfaces 103 and a single curved surface 105 that oppose each other and prevent rotation of a valve lifter 200, such as shown in FIG. 2. The innermost surfaces of the inwardly-curved surfaces 103 and 105 are advantageously shown incorporating a draft, i.e., the end 115 of the curved surfaces 103 and 105 at the platform 107 is not as thick as at the end 117 of the curved surfaces 103 and 105 at the upper edge of the conduit 101, while the end 115 of the curved surfaces 103 and 105 at the platform 107 is further from the center of the conduit 101 than the end 117 of the curved surfaces 103 and 105 at the upper edge of the conduit 101. The draft facilitates a tighter grip of the valve lifter 200 at the upper or outermost edge 117 of the conduit 101.

A platform 107 may be disposed inside the conduit 101. The platform 107 is advantageously planar and substantially radially disposed with respect to an axial component of the conduit 101, e.g., perpendicular to a base 111 through the center of the conduit 101. A plurality of holes 109, 110 disposed in the platform 107 includes a large hole 109 substantially in the center of the conduit 101, and, optionally, a number of smaller holes 110 near the inner surface of the conduit 101. A push rod extends from the valve lifter 200 to the cylinder head of an internal combustion engine through the large hole 109.

Two conduits 101 are shown disposed on the base 111. The two conduits 101 advantageously extend in the same direction axially, i.e., the axial orientation of the conduits 101 is substantially parallel to each other and perpendicular to the base 111. In the valve lifter guide 100 shown in FIG. 1, two bases 111 support four conduits 101. The bases 111 are connected by a link 113, such that four valve lifters 200 are guided. Optionally, a hole in the link 113 may be provided to attach the guide 100 to an engine. Although four or six conduits are shown in the embodiments of the drawings, any number of conduits 101 may be included in the valve lifter guide 100, for example, 1, 2, 3, 5, 7, 8, and so forth, as needed.

A valve lifter 200 that engages the valve lifter guide 100 is shown in FIG. 2. A roller mechanism 201 is shown opposite to a lifter interface 203 that includes a pair of curved surfaces 205 opposing each other. Similarly, the lifter interface 203 includes a pair of flat surfaces 207 that are substantially parallel on opposite sides of the lifter interface 203.

A perspective view of a valve lifter 200 engaging the valve lifter guide 100 is shown in FIG. 3. A valve lifter 200 is shown inserted into one of the conduits 101 of the valve lifter guide 100. The flat surfaces 207 of the lifter interface 203 engage the curved surfaces 103 and opposing curved surface 105. In this manner, the valve lifter guide 100 securely holds the valve lifter 200 during assembly and also prevents rotation of the valve lifter 200 during engine operation.

A top view of the valve lifter guide engaging a valve lifter is shown in FIG. 4. A close-up view of a cross-section of the lifter interface 203 inserted into the conduit 101 shows engagement of the opposing flat surfaces 207 of the valve lifter 200 with the curved surfaces 103 and 105. An optional gap 401 between the curved ends 205 of the valve lifter 200 and the guide 100 advantageously provides play in how the valve lifter 200 fits within the valve lifter guide 100. The gap 401 provides a more flexible way for the valve lifters 200 to be inserted with respect to the push rods of the internal combustion engine. Although it is advantageous that the curved surfaces 103 and 105 provide an interference fit with the flat surfaces 207 of the valve lifter 200, a looser fit may be provided between the components, so long as rotation of the valve lifter 200 is prevented during engine operation. Lubricating oil as well as air to moves between the valve lifter 200 and the inner surface of the conduit 101 at the gaps 401.

Figure 6:
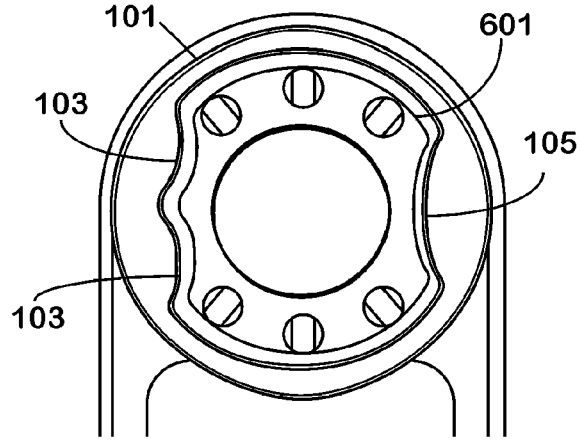
FIG. 6 is a top view of the valve lifter guide in accordance with the invention.

A top view of the valve lifter guide engaging a valve lifter at an optional location is shown in FIG. 5. Assembly structures 501 may optionally be provided either extending from or near the platform surface 107 to more closely engage the valve lifter 200 during assembly. These assembly structures 501, such as small rounded teeth, are close enough to the platform 107 such that they engage the valve lifter during assembly, but do not interfere with the movement of the valve lifter 200 during normal engine operation. If, for example, the valve lifter 200 remains 5 mm from the platform 107 during operation, the assembly structures 501 may be 3 mm or 4 mm from the platform 107. An alternative assembly structure 601 shown in FIG. 6 incorporates a smaller mimic of the curved shape of the inner edge surface of the conduit 101, disposed on the platform 107, but slightly radially inward of end 115 of the curved surfaces. The inner surface of the assembly structure 601 advantageously has an interference fit with the outer surface of the lifter interface 203 of the valve lifter 200 during assembly, but does not touch the valve lifter 200 during normal engine operation.

Figure 8:
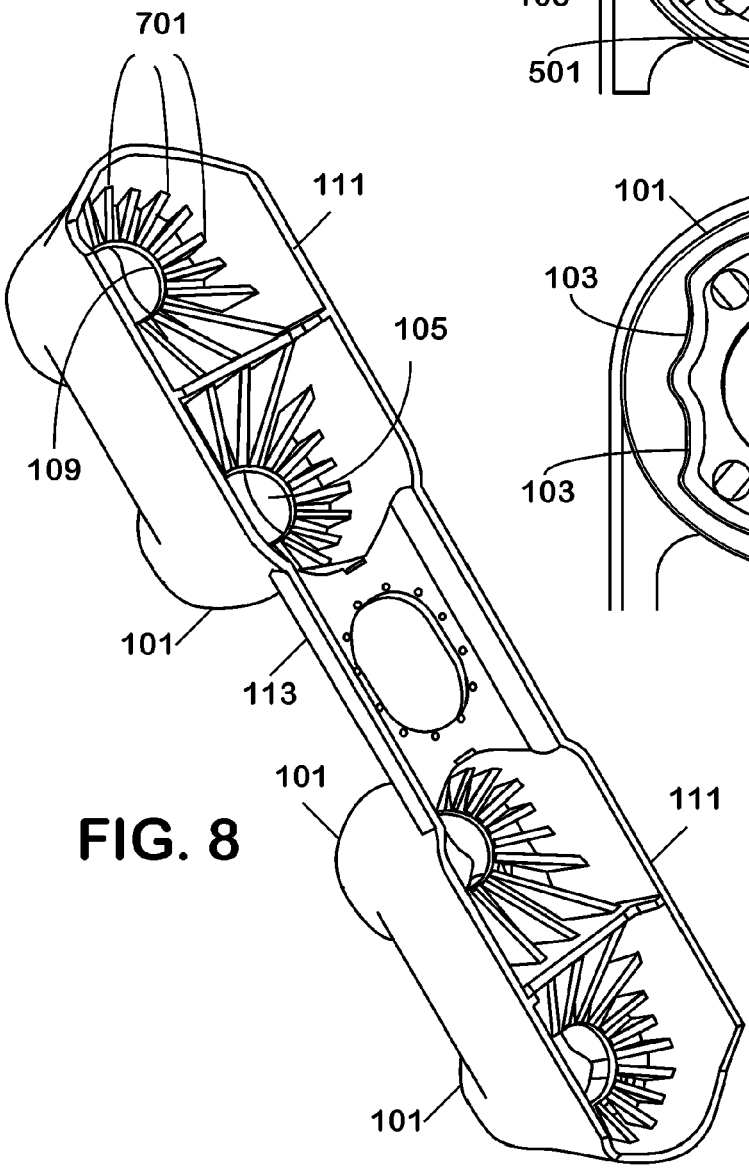
FIG. 8 is a bottom perspective view of a valve lifter guide in accordance with the invention.

A top view of the valve lifter guide is shown in FIG. 7. A plurality of ribs 701 are shown disposed through the smaller holes 109 in the platform 107. This arrangement is advantageously repeated in each of the conduits of the valve lifter guide. A bottom perspective view of the valve lifter guide 100, as shown in FIG. 8, shows the ribs 701 from below. The ribs 701 provide support between the platform 107 and the base 111. The ribs 701 also help guide the pushrod into the valve lifter 200. A perspective bottom view of the valve lifter guide shows the ribs 701 in more detail in FIG. 8.

Figure 9:
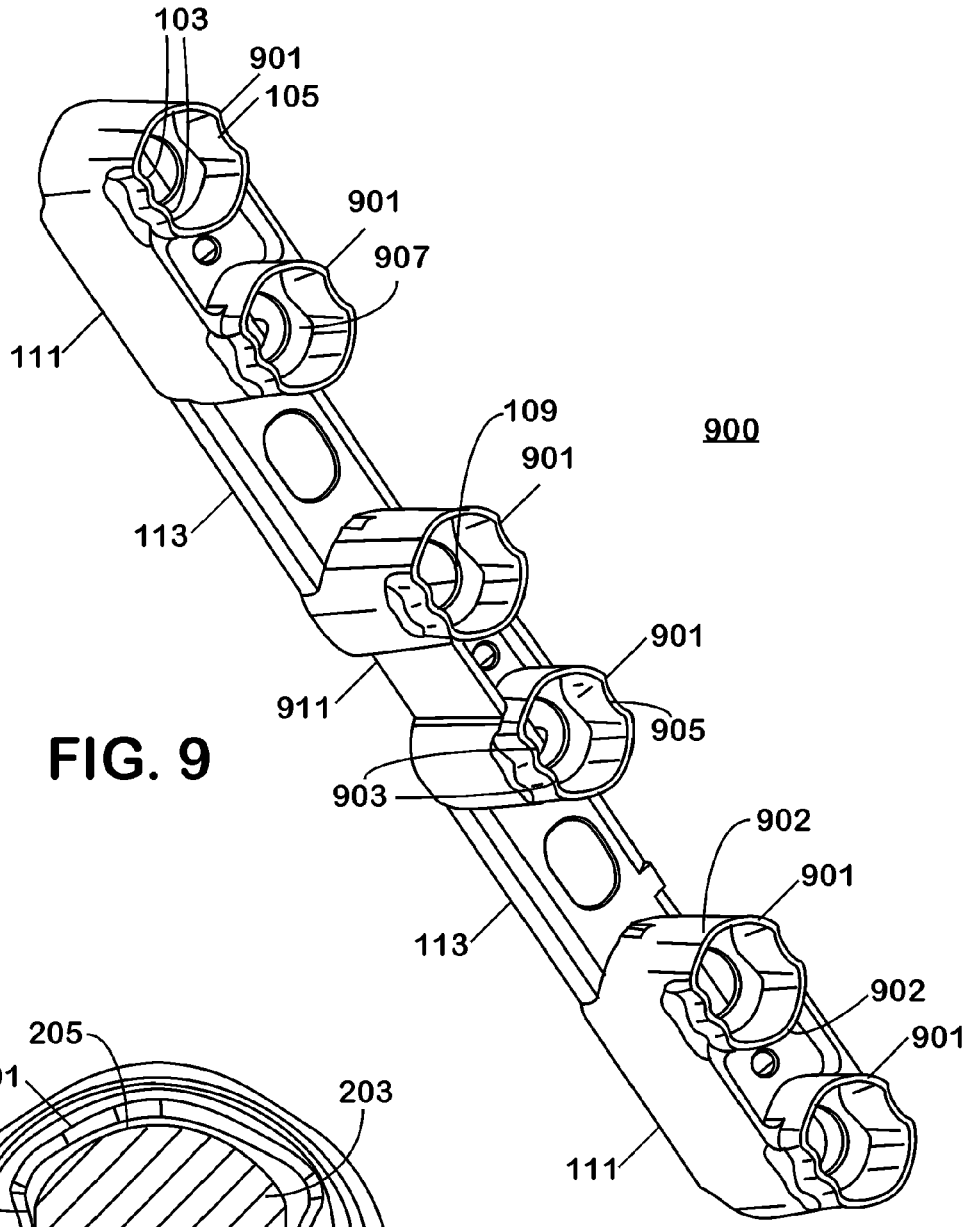
FIG. 9 is a perspective view of an alternative valve lifter guide having in accordance with the invention.

A perspective view of an alternative valve lifter guide 900 is shown in FIG. 9. The valve lifter guide 900 is similar to the valve lifter guide 100, with several alternative features. The conduits 901 are different in shape in that the walls that contain the inwardly-curved surfaces 103 and 105 have substantially even thickness at the end of the conduit 901. This feature advantageously facilitates manufacture of the valve lifter guide 900 with injection-mold processes. These conduits 901 provide a flexible yet strong grip on the valve lifters 200 during assembly as well as during engine operation. The walls 902 may advantageously be thinner than the walls having the inwardly-curved surfaces 103 and 105 in order to make the conduit 900 more flexible during engine operation. The shape of the inner surfaces of the conduits 901 may be the same as the inner surfaces of the conduits 101 in previous figures. The inwardly-curved surfaces 103 and 105, which have contact sites that contact the valve lifter 200 similar to the valve lifter guide 100, have corresponding outer curved surfaces 903 and 905, respectively. These curved surfaces 103, 105, 903, and 905 may incorporate a draft as previously described. The platform 107 of the valve lifter guide 900 has a large hole 109 disposed in it. The valve lifter guide 900 has six conduits 901 dispersed along two bases 111 and an alternate base 911. The alternative base 911 is narrower than the other bases 111 and may be utilized, for example, when the other base 111 is too wide to accommodate other engine parts when the valve lifter guide 900 is installed on an engine. The bases 111 and 911 are connected by links 113. One or more of these alternative features may be applied in any combination with the valve lifter guide 100 shown in the other figures.

Figure 10:
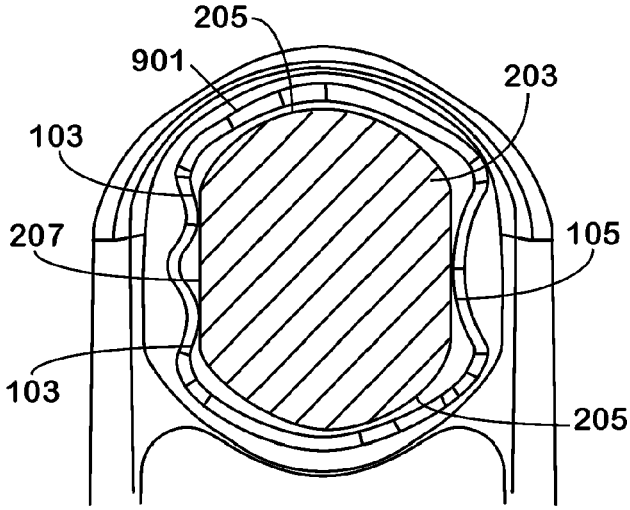
FIG. 10 is a top view of an alternative valve lifter guide in accordance with the invention.

A top view of an alternative valve lifter guide is shown in FIG. 10. The length of the opening of the conduit 901 (or the conduit 101 of FIG. 1, if desired) may optionally be sized such that the curved ends 205 of the valve lifter 200 are close to or just touching the inner end of the conduit 901 to limit the play in how the valve lifter 200 engages the conduit 901, thereby improving the ability to prevent rotation of the valve lifter 200. One or more of the conduits 901 may incorporate this feature. As shown in FIG. 10, the contact sites, e.g., where the two inwardly-oriented curves of the first inwardly-curved surface 103 and the single inwardly-oriented curve of the second inwardly-curved surface 105 meet the flat surfaces 207 of the valve lifter 200, do not directly oppose each other.

Figure 11:
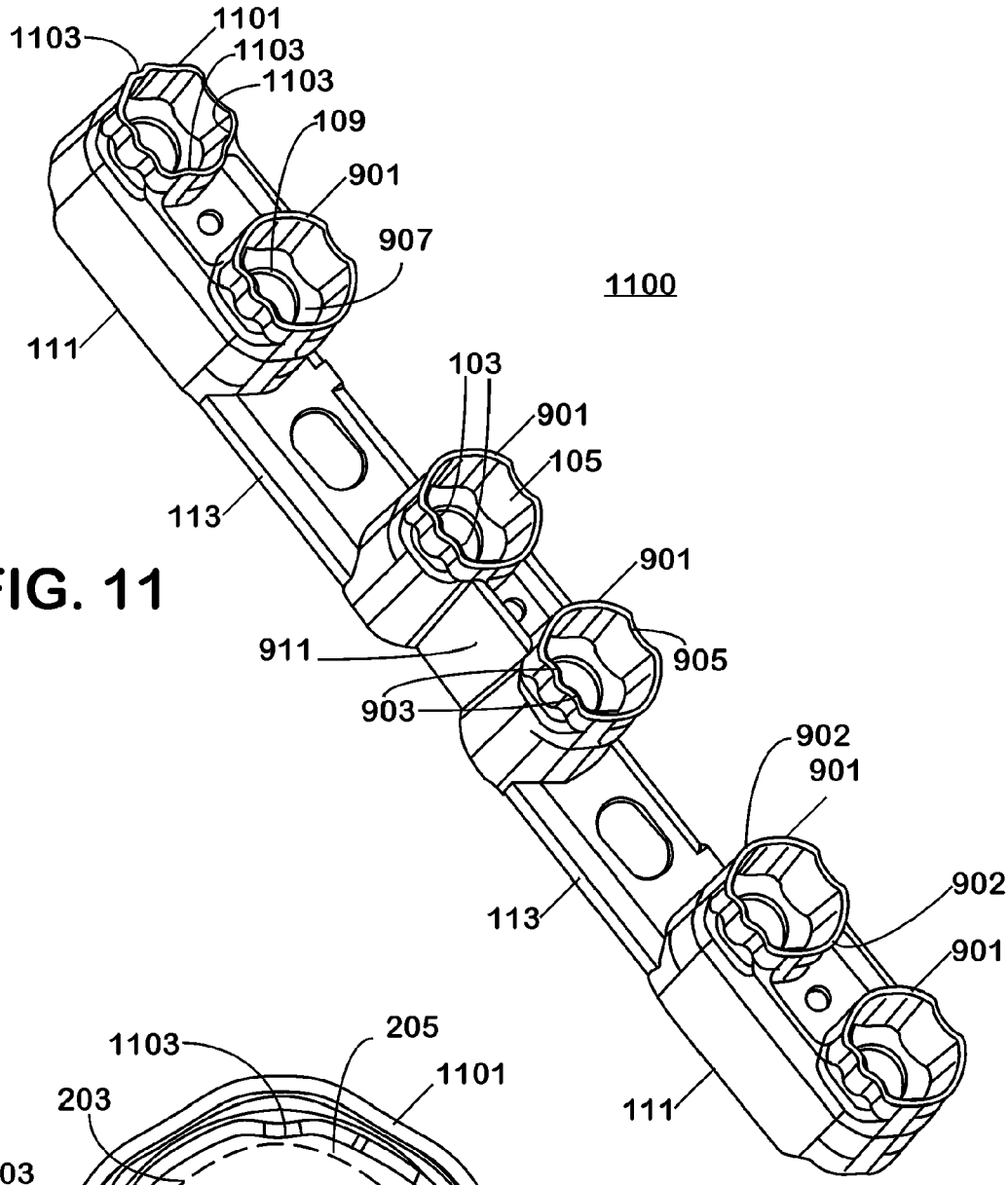
FIG. 11 is a perspective view of a valve lifter guide having alignment surfaces in accordance with the invention.

A perspective view of a valve lifter guide 1100 having alignment surfaces 1103 is shown in FIG. 11. The alignment surfaces 1103 limit the play in how the valve lifter 200 engages the conduit 1101, thereby improving the ability to prevent rotation of the valve lifter 200. Although the alignment surfaces 1103 are shown only in the first conduit 1101 of the valve lifter guide 1100, the alignment surfaces 1103 may be provided in more than one conduit of the guide 1100.

Figure 12:
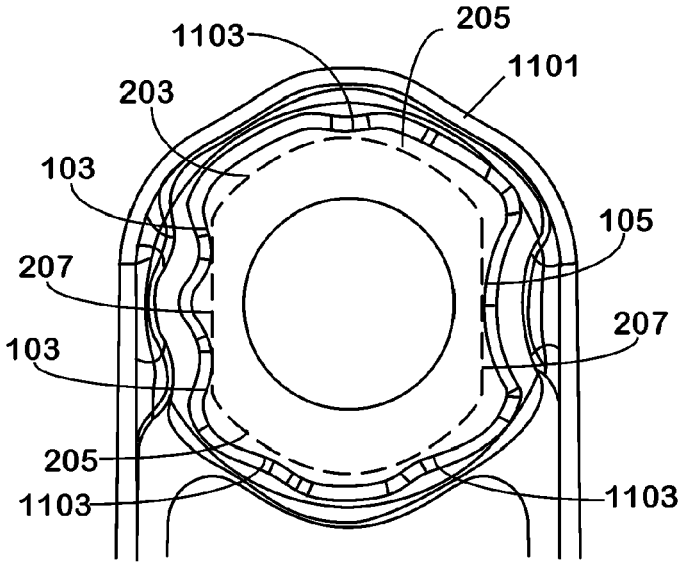
FIG. 12 is a top view of a valve lifter guide having alignment surfaces in accordance with the invention.

As shown in the top view of the conduit 1101 in FIG. 12, the inner surface of the conduit includes a plurality of inwardly-curved alignment surfaces 1103. In the application of alignment surfaces 1103 shown in FIG. 12, an alignment surface 1103 comprising a single convex surface is shown approximately centered near the first curved end 205 of the valve lifter 200 at the top of the drawing, and the alignment surface 1103 at the bottom of the drawing comprises two convex surfaces that are shown spaced near the second curved end 205 of the valve lifter 200. The innermost peak, i.e., closest to the center of the conduit 1101, of the inwardly-curved alignment surface 1103 shown at the top of FIG. 12 does not directly oppose the innermost peak of either of the inwardly-curved alignment surfaces 1103 shown at the bottom of FIG. 12. Advantageously, only one of the curved ends 205 is close enough to touch the alignment surfaces 1103 closest to that end 205.

The guide 100, 900, 1100 is advantageously made of plastic, nylon, resin, or other suitable material, such as Nylon 6/6 with fiberglass and with or without molybdenum, Nylatron® GS 51 plastic from K-mac Plastics, Zytel® nylon from DuPont, or Hylon® N1033 resin from Entec. Strain relief (not shown) may additionally be provided as needed, for example, by eliminating sections of the material, as known in the art. Optionally, the valve guide 100 may be advantageously designed to allow the materials to stretch or flex, as needed, to receive and/or eject the valve lifter(s) 200.

Such design may include, for example, cut-outs in the material at strategic places, thinner areas of material, and/or use of more stretchable/flexible materials.

The present invention provides numerous advantages, including being inexpensive, easy to install, and not generating unwanted engine noise. During installation, valve lifters are securely held. More grip of valve lifters results in more securely held parts than with designs, for example, that incorporate a flat-sided two-finger approach. The more flexible conduits herein provide a flexible yet strong grip on valve lifters during assembly as well as during engine operation, which was not provided by prior guides. During engine operation, rotation is prevented.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A valve lifter guide comprising:

a base;

at least one conduit extending from the base, wherein the conduit includes a first inwardly-curved surface and a second inwardly-curved surface arranged such that the conduit maintains an orientation of a valve lifter between the first inwardly-curved surface and the second inwardly-curved surface, and wherein the conduit includes a third inwardly-curved surface and a fourth inwardly-curved surface arranged such that a first curved end of the valve lifter is near the third inwardly-curved surface and a second curved end of the valve lifter is near the fourth inwardly-curved surface, while preventing rotation of the valve lifter.

2. The valve lifter guide of claim 1, wherein the first inwardly-curved surface comprises at least two inwardly-oriented curves.

3. The valve lifter guide of claim 1, wherein the first inwardly-curved surface comprises a first contact site and a second contact site and the second inwardly-curved surface comprises a third contact site, such that the third contact site is not directly opposite to the first contact site and the third contact site is not directly opposite to the second contact site.

4. The valve lifter guide of claim 1, wherein the third inwardly-curved surface comprises at least two inwardly-oriented curves.

5. The valve lifter guide of claim 1, further comprising a platform disposed in the conduit substantially radially with respect to an axial aspect of the conduit, and wherein the platform comprises at least one hole capable of facilitating a push rod that engages the valve lifter.

6. The valve lifter guide of claim 1 comprising at least two conduits, both extending in one direction from the base.

7. The valve lifter guide of claim 1, wherein the conduit has a continuously curving inner surface.

8. The valve lifter guide of claim 1, wherein the first inwardly-curved surface and the second inwardly-curved surface are each disposed in a wall having substantially even thickness.

9. A valve lifter guide comprising:

a base;

a first conduit extending from the base, wherein the first conduit has a first inwardly-curved surface opposite from a second inwardly-curved surface, wherein the first inwardly-curved surface engages a first surface of a valve lifter while the second inwardly-curved surface engages a second surface of the valve lifter, which second surface is substantially parallel to the first surface, wherein the conduit includes a first inwardly-curved alignment surface and a second inwardly-curved alignment surface arranged such that a first curved end of the valve lifter is near the first inwardly-curved alignment surface and a second curved end of the valve lifter is near the second inwardly-curved alignment surface, while preventing rotation of the valve lifter.

10. The valve lifter guide of claim 9, wherein the first inwardly-curved surface comprises at least two inwardly-oriented curved surfaces.

11. The valve lifter guide of claim 9, wherein the first inwardly-curved surface comprises a first contact site and a second contact site and the second inwardly-curved surface comprises a third contact site, such that the third contact site is not directly opposite to the first contact site and the third contact site is not directly opposite to the second contact site.

12. The valve lifter guide of claim 9, wherein the first inwardly-curved alignment surface comprises a first inwardly-oriented curve and a second inwardly-oriented curve and the second inwardly-curved alignment surface comprises a third inwardly-oriented curve, wherein an innermost peak of the third inwardly-oriented curve is not directly opposite to an innermost peak of the first inwardly-oriented curve and the innermost peak of the third inwardly-oriented curve is not directly opposite to an innermost peak of the second inwardly-oriented curve.

13. The valve lifter guide of claim 9, further comprising a platform disposed in the first conduit, wherein the platform comprises at least one hole capable of facilitating a push rod that engages the valve lifter.

14. The valve lifter guide of claim 9, further comprising a plurality of ribs disposed in the base.

15. The valve lifter guide of claim 9, further comprising a second conduit extending in the same direction from the base as the first conduit extends from the base.

16. The valve lifter guide of claim 9, further comprising a second base having at least two conduits extending from the second base in the same direction from the base as the first conduit extends from the base.

17. The valve lifter guide of claim 9, wherein the first conduit has a continuously curving inner surface.

18. The valve lifter guide of claim 9, wherein the first conduit has a substantially curved outer surface.

19. The valve lifter guide of claim 9, wherein the first inwardly-curved surface and the second inwardly-curved surface are each disposed in a wall having substantially even thickness.

20. A conduit comprising:

a first inwardly-curved surface having at least two inwardly-oriented curved surfaces and a first contact site and a second contact site;

a second inwardly-curved surface opposed to the first inwardly-curved surface and having a third contact site;

wherein the conduit contacts a valve lifter at the first contact site, the second contact site, and the third contact site and prevents rotation of the valve lifter;

wherein the conduit includes at least two inwardly-curved alignment surfaces near the at least two curved ends of the valve lifter.

* * * * *